US008890645B2

(12) United States Patent
Hu

(10) Patent No.: US 8,890,645 B2
(45) Date of Patent: Nov. 18, 2014

(54) COMPOSITE ISOLATING TRANSFORMER

(71) Applicant: Innotrans Technology Co., Ltd., Tainan (TW)

(72) Inventor: Jen-Yao Hu, Tainan (TW)

(73) Assignee: Innotrans Technology Co., Ltd, Taipei (TW)

( * ) Notice: Subject to any disclaimer, the term of this patent is extended or adjusted under 35 U.S.C. 154(b) by 0 days.

(21) Appl. No.: 13/933,507

(22) Filed: Jul. 2, 2013

(65) Prior Publication Data

US 2014/0085036 A1 Mar. 27, 2014

(30) Foreign Application Priority Data

Sep. 26, 2012 (TW) ..... 101218601 U

(51) Int. Cl.

| | |
|---|---|
| ***H01F 27/30*** | (2006.01) |
| ***H01F 27/02*** | (2006.01) |
| ***H01F 27/29*** | (2006.01) |
| ***H01F 27/26*** | (2006.01) |

(52) U.S. Cl.

CPC ..... *H01F 27/306* (2013.01); *H01F 27/263* (2013.01)

USPC ..... 336/198; 336/90; 336/192; 336/196; 336/208

(58) Field of Classification Search

USPC ..... 336/196, 198, 90, 192, 208

See application file for complete search history.

(56) References Cited

U.S. PATENT DOCUMENTS

| | | | | |
|---|---|---|---|---|
| 8,022,803 | B2 * | 9/2011 | Park et al. | 336/208 |
| 2007/0285203 | A1 * | 12/2007 | Ger et al. | 336/208 |
| 2008/0024262 | A1 * | 1/2008 | Chang et al. | 336/208 |

FOREIGN PATENT DOCUMENTS

| | | |
|---|---|---|
| TW | 385047 U | 3/2000 |
| TW | 415625 | 12/2000 |
| TW | 420363 | 1/2001 |
| TW | M425378 | 3/2012 |
| TW | I371763 | 9/2012 |

* cited by examiner

*Primary Examiner* — Tsz Chan

(74) *Attorney, Agent, or Firm* — Muncy, Geissler, Olds & Lowe, P.C.

(57) ABSTRACT

A composite isolating transformer includes a main winding rack and a support rack. The main winding rack includes two winding portions coaxially formed to hold respectively a primary coil and a secondary coil, and a separating portion between the two winding portions. The support rack includes a first support half member and a second support half member coupling together to encase at least one winding portion. The first and second support half members have respectively a first cover and a second cover to cover two lateral sides of the winding portion, respectively a first insulating portion and a second insulating portion corresponding to the separating portion and extending towards the separating section to couple together, and respectively a first isolating portion and a second isolating portion extended from the first and second insulating portions towards the winding portion to cover another two lateral sides of the winding portion.

6 Claims, 5 Drawing Sheets

COMPOSITE ISOLATING TRANSFORMER

FIELD OF THE INVENTION

The present invention relates to an isolating transformer and particularly to a composite isolating transformer.

BACKGROUND OF THE INVENTION

In most types of electric products implemented through electric power transformers play an important role in power transformation or signal isolation. A general transformer has various electric parameters when in use that are preset at the stage of research and production, such as power conversion ratio, mutual inductance value generated when winding coils are energized or loss occurring when the current passes through the winding coils. Then design is made for the transformer structure such as winding coil, winding rack or iron core according to the aforesaid electric parameters. By adjusting the coil ratio of the winding coils or interval between the winding zones on the winding rack, the produced transformer can generate the electric parameters the same as the original design.

A conventional transformer includes a first winding wound by a primary coil, a second winding wound by a secondary coil and an iron core running through the first and second windings. The primary coil and secondary coil are respectively a low voltage coil and a high voltage coil. The high voltage coil generates a creeping discharge problem upon receiving an input voltage. If this creeping discharge is not being isolated, the lower voltage coil could be broken down by the high voltage to result in damage of the transformer. To remedy this problem, Taiwan patent Nos. 385047, 415625 and 420363 disclose a structure with an increased creeping distance to prevent the high-voltage breakdown phenomenon. But it still has a problem of being unable to wind the primary coil and secondary coil at the same time.

Moreover, the winding rack can be implemented in many types, mainly can be divided in a vertical type and a horizontal type. An example of the vertical type can be found in Taiwan patent No. M425378, while the horizontal type is found in Taiwan patent No. I371763. Either of them relies on machining or injection molding to form a fixed structure after the structural specification of the winding rack is determined. The so-called structural specification means the interval between the winding zones of various winding coils on the winding rack or the position of the iron core. Once the specification is determined, the winding rack cannot be altered or adjusted according to requirements. As a result, the winding rack has to be redesigned to comply with the requirements. In the event that the alteration of the specification is merely slight, the redesign of the winding rack increases the production cost. In addition, in terms of the electric parameters of the transformer, there is a great relationship between the winding rack structure and leakage inductance of the winding coils. To provide a transformer winding rack structure with adjustable leakage inductance between various winding coils is a commendable approach to overcome the aforesaid problems.

SUMMARY OF THE INVENTION

The primary object of the present invention is to provide a transformer structure that can isolate creeping discharge and allow winding of the high voltage coil and low voltage coil at the same time, and also overcome the problem of being unable to adjust leakage inductance in response to requirement due to fixed winding rack structure in the conventional technology.

To achieve the foregoing object, the invention provides a composite isolating transformer that mainly includes a main winding rack and a support rack mounted onto the main winding rack. The main winding rack includes two winding portions coaxially formed to hold respectively a primary coil and a secondary coil, two connecting portions at two opposite ends of the two winding portions, a separating portion located between the two winding portions with two spacers spaced from each other to form a separating section between them to separate the two winding portions, and an installation channel running through the two winding portions to hold an iron core set which is magnetically coupled with magnetic paths generated by the primary coil and secondary coil when electricity is provided. The support rack includes a first support half member and a second support half member that correspond to each other and couple together to encase at least one winding portion. The first support half member and second support half member have respectively a first cover and a second cover corresponding to each other to cover two lateral sides of the winding portion, respectively a first insulating portion and a second insulating portion corresponding to the separating portion and extending towards the separating section to couple together, and respectively a first isolating portion and a second isolating portion extended from the first insulating portion and the second insulating portion towards the winding portion to cover another two lateral sides of the winding portion.

In one embodiment each connecting portion includes a first retaining portion located at an opening of one end of the installation channel and two latch recesses at two sides of the first retaining portion. The first support half member and second support half member have respectively a first latch portion and a second latch portion wedged in the two latch recesses, and respectively a first positioning portion and a second positioning portion connected to the first and second latch portions to butt the first retaining portion.

In another embodiment each winding portion has a second retaining portion located above and corresponding to the first retaining portion. The first support half member and second support half member have respectively a first ancillary positioning portion and a second ancillary positioning portion to butt one side of the second retaining portion.

In yet another embodiment the composite isolating transformer includes a leakage inductance adjustment element mounted onto the support rack and a magnetic element embedded in the leakage inductance adjustment element. The first support half member has a first assembly portion extended from the first ancillary positioning portion and located above the first latch portion. The second support half member has a second assembly portion extended from the second ancillary positioning portion and located above the second latch portion. The leakage inductance adjustment element has two tracks connected respectively to the first assembly portion and second assembly portion.

In yet another embodiment the iron core set is selected from the group consisting of EE, EI, FI, FF, TU, UU and UI types.

In yet another embodiment the composite isolating transformer includes an ancillary insulating portion corresponding to the junction of the first isolating portion and second isolating portion.

In yet another embodiment the two spacers are formed at different heights.

The invention thus formed provides many advantages, notably:

1. The support rack is formed by the first support half member and second support half member, and assembly is easier. Moreover, through coupling of the first isolating portion on the first support half member and the second isolating portion on the second support half member, the winding portion can be partially covered to increase the separating distance between the primary coil and secondary coil to improve electric isolation.

2. Through the composite support rack, after the primary coil and secondary coil are wound simultaneously on the two winding portions, the support rack can be mounted onto the two winding portions, therefore production speed can be increased.

3. Redesign of the winding rack is no longer necessary. Through the leakage inductance adjustment element located above the support rack, and the magnetic element masking the upper side of the primary and secondary coils, the magnetic paths generated by the primary coil and secondary coil after being energized can pass through the magnetic element to increase magnetic coupling intensity, thereby reduce the leakage inductance between the primary and secondary coils. Therefore, the leakage inductance can be adjusted by altering the masked position of the magnetic element over the two winding portions, such that the problem of constant redesign of the winding rack can be overcome.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
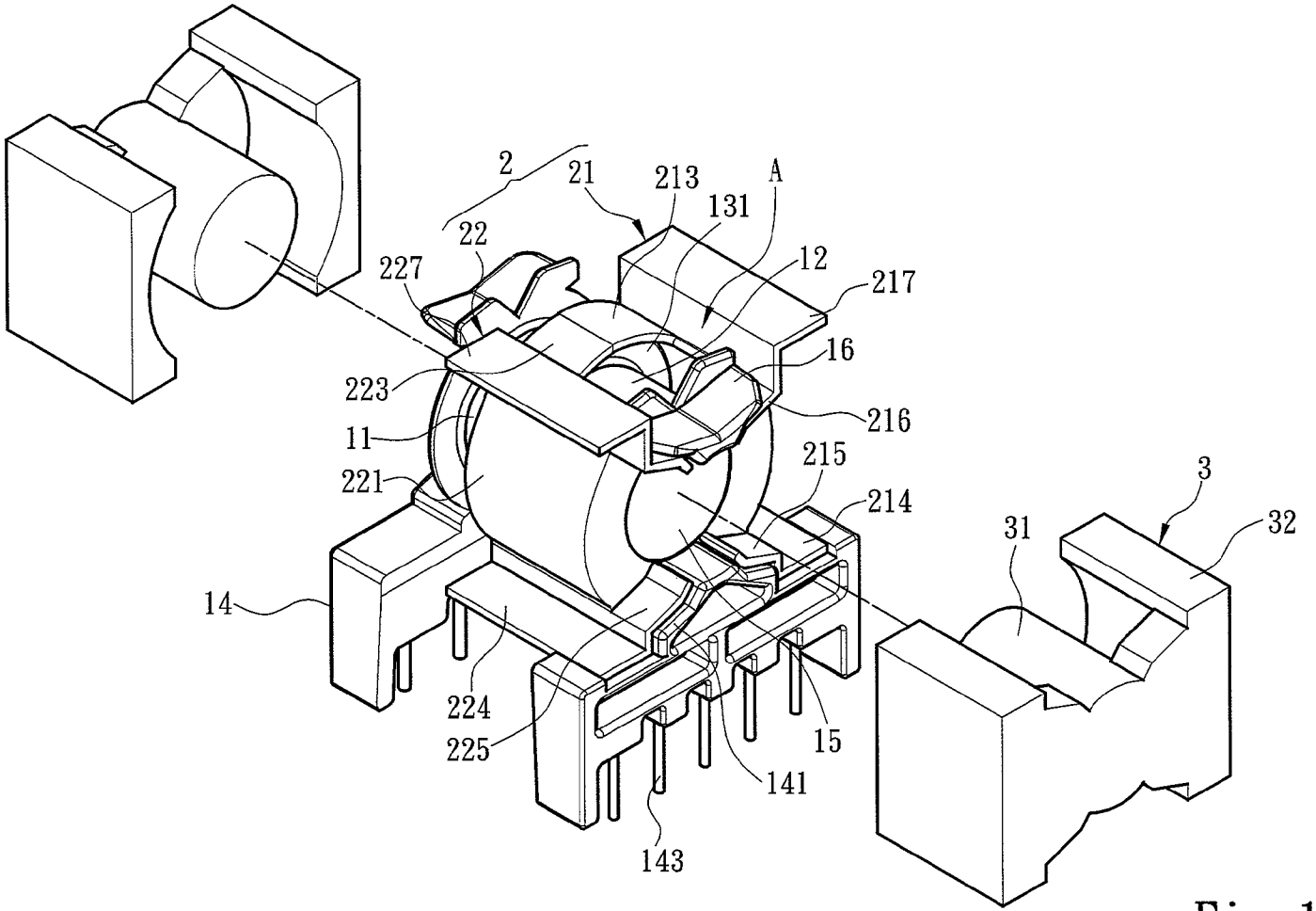
FIG. 1 is a schematic view of a first embodiment of the invention in an assembly condition.
Figure 2:
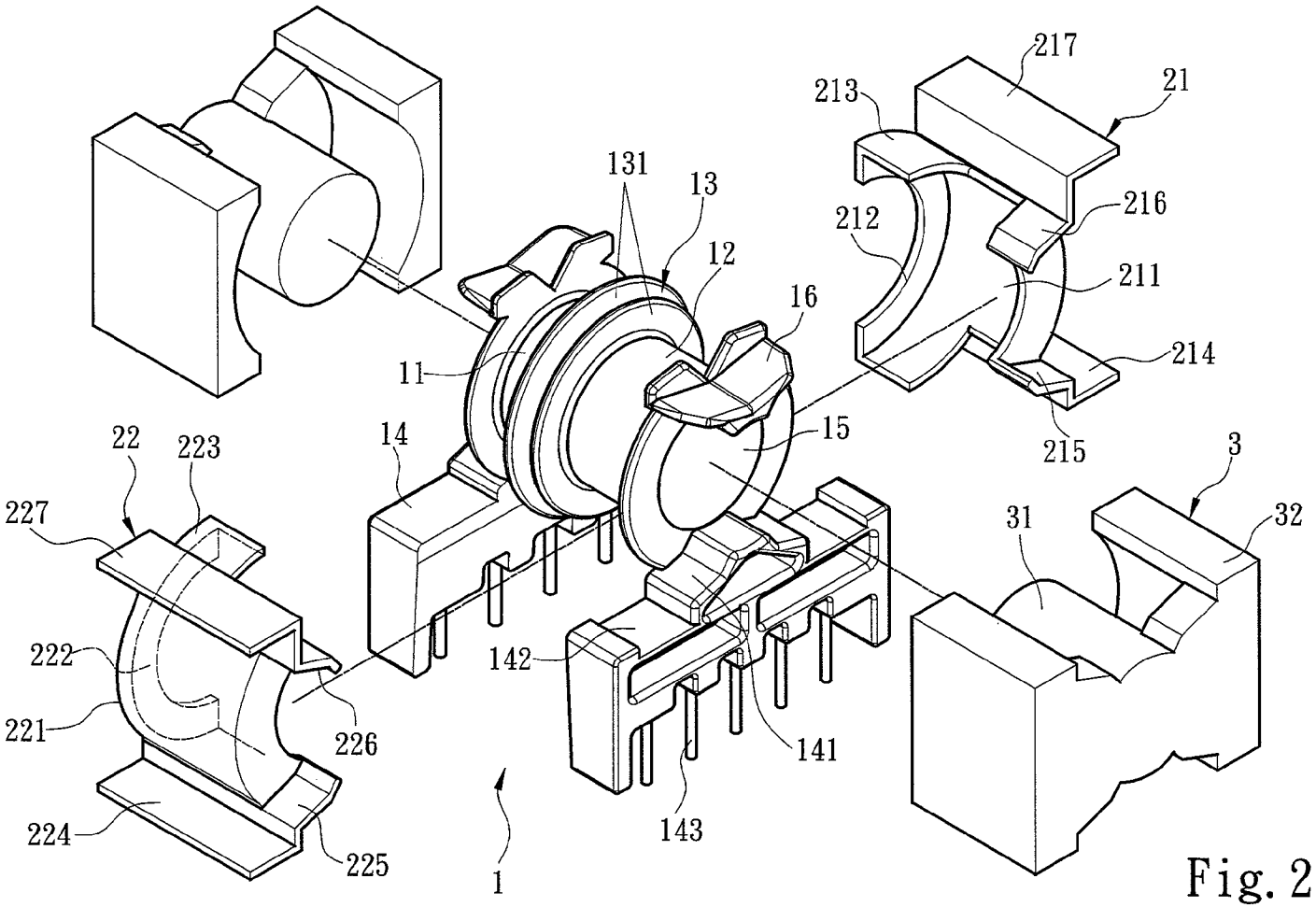
FIG. 2 is an exploded view of an embodiment of the invention.
Figure 3:
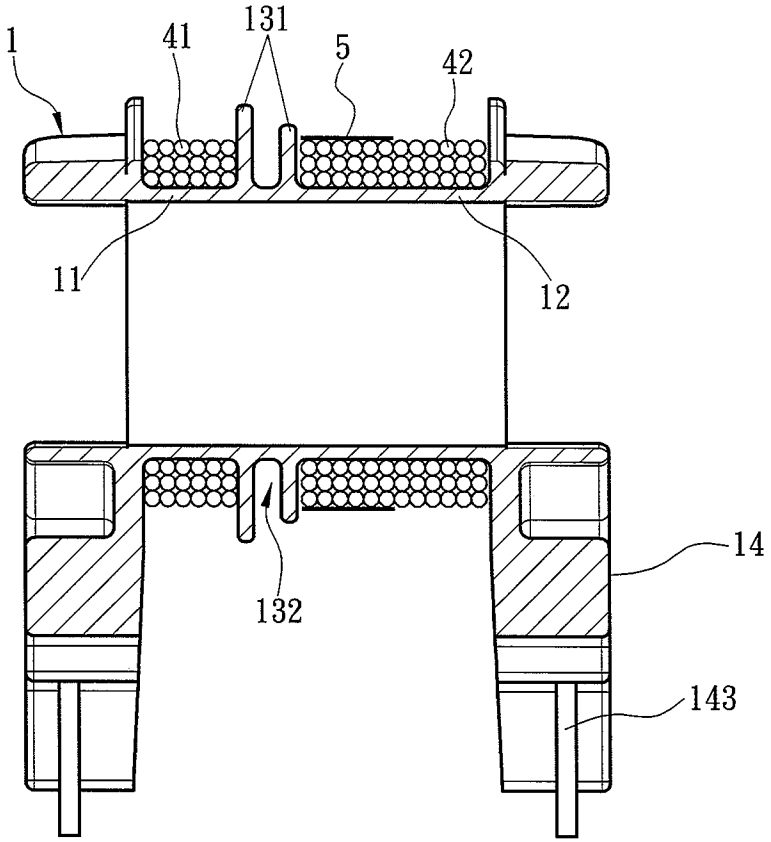
FIG. 3 is a cross section of an embodiment of the invention.

Please refer to FIGS. 1, 2 and 3 for an embodiment of a composite isolating transformer of the invention. It includes a main winding rack 1 and a support rack 2 mounted onto the main winding rack 1. The main winding rack 1 has two winding portions 11 and 12 coaxially formed to hold respectively a primary coil 41 and a secondary coil 42, a separating portion 13 located between the two winding portions 11 and 12 to separate them, two connecting portions 14 at two opposite ends of the two winding portions 11 and 12, and an installation channel 15 running through the two winding portions 11 and 12 to hold an iron core set 3 which is magnetically coupled with magnetic paths generated by the primary coil 41 and secondary coil 42 when electricity is provided.

More specifically, the separating portion 13 includes two spacers 131 between the two winding portions 11 and 12, and a separating section 132 between the two spacers 131 to separate the two winding portions 11 and 12. The two spacers 131 are formed at different heights. The support rack 2 includes a first support half member 21 and a second support half member 22 that correspond to each other and couple together to encase at least one winding portion 12. The first support half member 21 and second support half member 22 have respectively a first cover 211 and a second cover 221 corresponding to each other to cover two lateral sides of the winding portion 12, respectively a first insulating portion 212 and a second insulating portion 222 corresponding to the separating portion 13 and extending towards the separating section 132 to couple together, and respectively a first isolating portion 213 and a second isolating portion 223 extended from the first insulating portion 212 and the second insulating portion 222 towards the winding portion 12 to cover another two lateral sides of the winding portion 12. The first and second isolating portions 213 and 223 are coupled together to form electric isolation between the primary coil 41 and the secondary coil 42 after they are energized by electricity. The embodiment of the two winding portions 11 and 12 depicted in the drawings is not the limitation of the invention. Their length can be adjusted according to the wound coil number of the primary coil 41 and secondary coil 42. The iron core set 3 can be EE, EI, FI, FF, TU, UU or UI type.

In one embodiment of the invention, in order to facilitate assembling and positioning the first support half member 21 and second support half member 22, each connecting portion 14 includes a first retaining portion 141 at the opening of one end of the installation channel 15, two latch recesses 142 located at two sides of the first retaining portion 141, and a plurality of pins 143. The first support half member 21 has a first latch portion 214 at one side opposite to the first insolating portion 213 to be wedged in one latch recess 142 and a first positioning portion 215 connecting to the first latch portion 214 and butting one side of the first retaining portion 141. The second support half member 22 also has a second latch portion 224 at one side opposite to the second insolating portion 223 to be wedged in another latch recess 142 and a second positioning portion 225 connecting to the second latch portion 224 and butting another side of the first retaining portion 141. More specifically, the first retaining portion 141 is formed in a stepped shape at two sides to connect to the two latch recesses 142. The first and second positioning portions 215 and 225 are formed in a shape to mate the first retaining portion 141. During assembly, the primary coil 41 and secondary coil 42 are first wound respectively on the two winding portions 11 and 12, and then the first and second support half members 21 and 22 are coupled together from the left and right sides of the main winding rack 1; meanwhile, the first and second positioning portions 215 and 225 respectively butt two sides of the first retaining portion 141 with the first and second latch portions 214 and 224 wedged in the two latch recesses 142, thereby the first and second support half members 21 and 22 are firmly mounted. Finally, the iron core set 3 runs through the installation channel 15 to be installed on the main winding rack 1 to finish assembly of the invention. For disassembling the support rack 2, only the first and second latch portions 214 and 224 are needed to be lifted upwards to separate from the two latch recesses 142, so that the first support half member 21 and second support half member 22 can be separated from the main winding rack 1.

In addition, the main winding rack 1 has two second retaining portions 16 located above and corresponding to the two first retaining portions 141. The first support half member 21 has a first ancillary positioning portion 216 located above the first positioning portion 215 and leaned on one side of the second retaining portion 16. The second support half member 22 has a second ancillary positioning portion 226 located above the second positioning portion 225 and leaned on another side of the second retaining portion 16. During assembly of the support rack 2, the first and second support half members 21 and 22 are coupled towards the main winding rack 1 from two sides of the main winding rack 1 until the first and second ancillary positioning portions 216 and 226 butt two sides of the second retaining portion 16. The invention, through the design and structure of the first and second retaining portions 141 and 16, first and second positioning portions 215 and 225, first and second latch portions 214 and 224, and first and second ancillary positioning portions 216 and 226, can be assembled easily without the trouble of alignment.

In the invention, the first and second covers 211 and 221 cover two sides of the winding portion 12 to isolate the secondary coil 42 and iron core set 3, and the first isolating portion 213 and second isolating portion 223 are coupled together to cover another two sides of the winding portion 12, therefore further increase the creeping distance between the primary coil 41 and secondary coil 42 and isolate them. To enhance efficacy of electric isolation between the primary coil 41 and secondary coil 42, the composite isolating transformer of the invention further has an ancillary insulating portion 5 attached to positions corresponding to the first and second isolating portions 213 and 223. The attached scope of the ancillary insulating portion 5 includes the junction of the first isolating portion 213 and second isolating portion 223. The ancillary insulating portion 5 can be an insulating tape.

Figure 4:
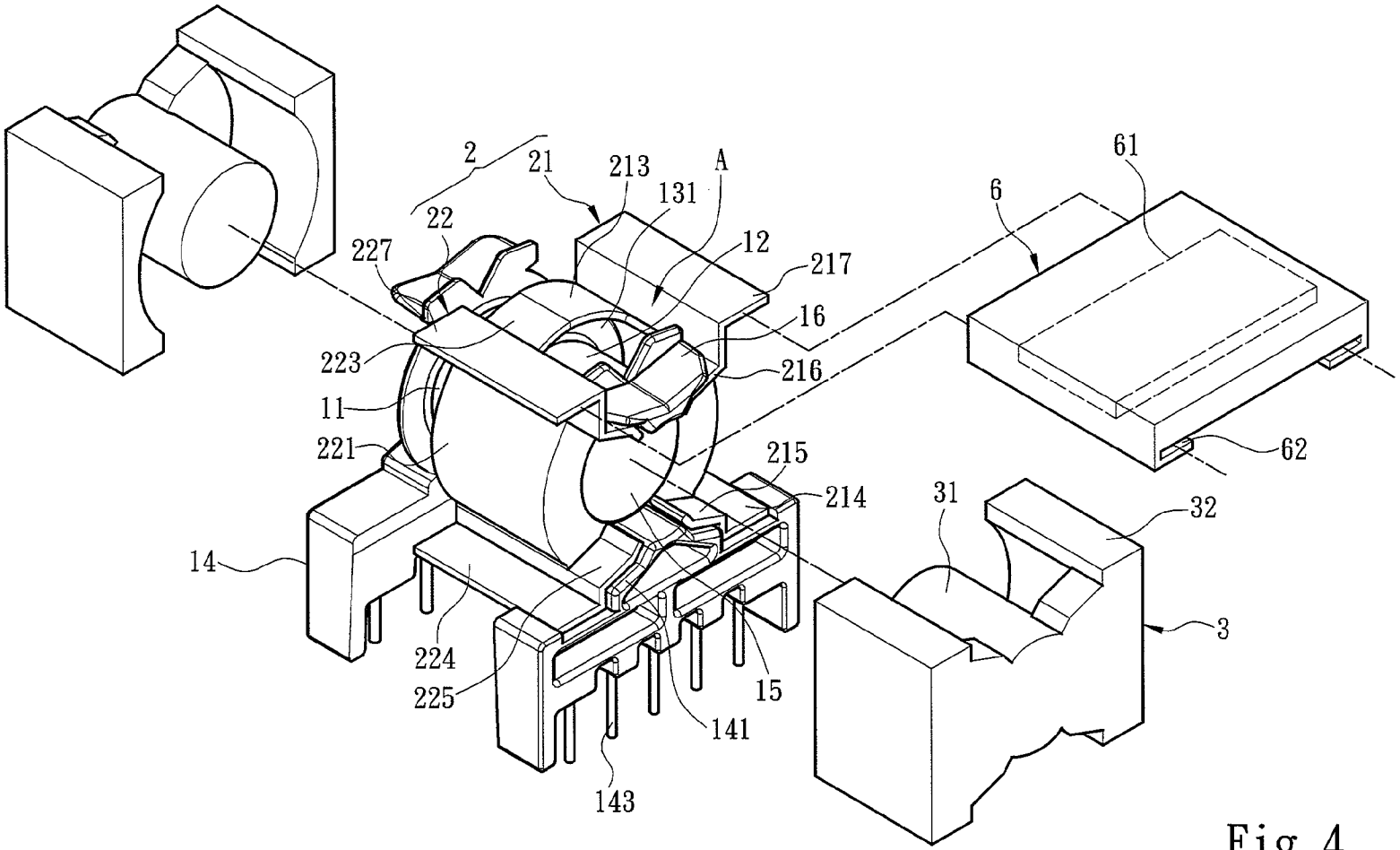
FIG. 4 is a schematic view of another embodiment of the invention in an assembly condition.

Please refer to FIG. 4 for another embodiment of the invention. The composite insulating transformer of the invention can further include a leakage inductance adjustment element 6 mounted on the support rack 2 and a magnetic element 61 embedded in the leakage inductance adjustment element 6. The magnetic element 61 allows the magnetic paths generated by the primary and secondary coils 41 and 42 after being energized by electricity to pass through, such that the magnetic coupling intensity is increased and leakage inductance between the primary and secondary coils 41 and 42 is reduced. More specifically, the first support half member 21 has a first assembly portion 217 extended from the first ancillary positioning portion 216 and located above the first latch portion 214, and the second support half member 22 has a second assembly portion 227 extended from the second ancillary positioning portion 226 and located above the second latch portion 224. The first and second assembly portions 217 and 227 form an assembly space A between them to hold the leakage inductance adjustment element 6. The leakage inductance adjustment element 6 has two tracks 62 to couple with the first and second assembly portions 217 and 227.

Figure 5A:
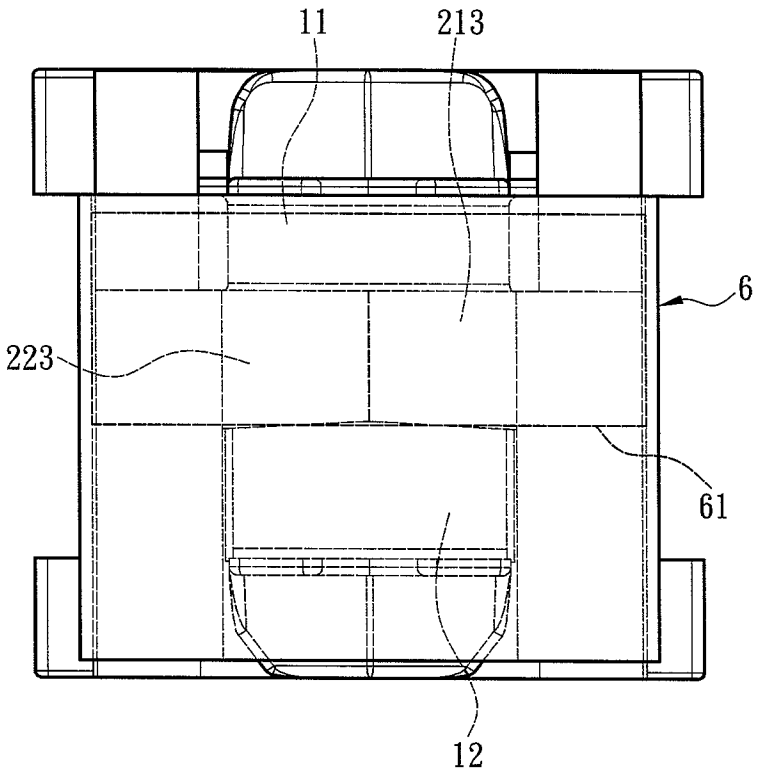
FIG. 5A is a top view of another embodiment of the invention.
Figure 5B:
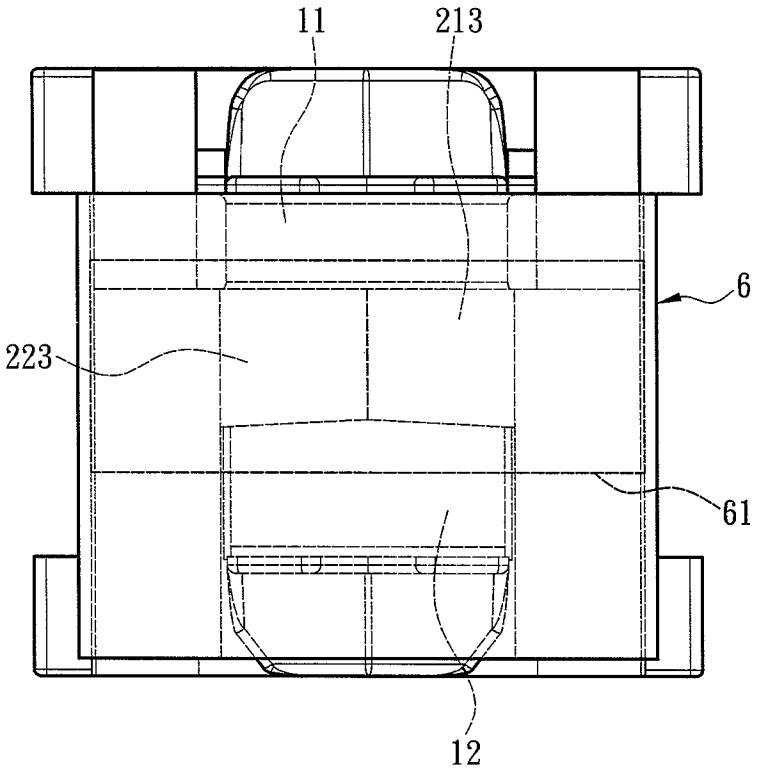
FIG. 5B is another top view of another embodiment of the invention.

In addition, the magnetic element 61 can be formed and adjusted at a length and width according to requirements to generate different leakage inductance adjustment effects. For instance, the magnetic element 61 can be formed at a greater area to cover evenly the two winding portions 11 and 12 to enhance magnetic coupling between the primary and secondary coils 41 and 42, thereby reduce the leakage inductance between the primary and secondary coils 41 and 42. However, the magnetic element 61 can generate different leakage inductance adjustment effects by covering the two winding portions 11 and 12 at different positions. FIG. 5A illustrates an example in which the magnetic element 61 covers evenly the two winding portions 11 and 12 so that magnetic coupling of the primary and secondary coils 41 and 42 improves when they are energized, therefore can reduce the leakage inductance between them. FIG. 5B illustrates another embodiment in which the magnetic element 61 covers one of the winding portions 11 and 12 greater. In this embodiment, although the magnetic coupling of the primary and secondary coils 41 and 42 also improves when being energized, compared with the one depicted in FIG. 5A, its leakage inductance reduced less. Hence through the covering degree of the leakage inductance adjustment element 6 over the two winding portions 11 and 12, different leakage inductances can be adjusted as desired.

The iron core set 3 shown in the drawings is EE type. More specifically, the iron core set 3 includes a central shaft 31 running through the installation channel 15 and two bracing arms 32 at two sides of the central shaft 31. The central shaft 31 runs through the installation channel 15 and is isolated from the primary and secondary coils through the winding portions 11 and 12. The two bracing arms 32 pass through below the first and second assembly portions 217 and 227 to isolate the iron core set 3 and secondary coil 42.

As a conclusion, the support rack 2 of the invention consists of the first support half member 21 and second support half member 22. Through the design and structure of the first and second retaining portions 141 and 16, first and second positioning portions 215 and 225, first and second latch portions 214 and 224, and first and second ancillary positioning portions 216 and 226, assembly is easier. Furthermore, the winding portions 11 and 12 can be wound by the primary and secondary coils 41 and 42 at the same time. The first isolating portion 213 of the first support half member 21 and second isolating portion 223 of the second support half member 22 are coupled together to partially cover the winding portion 12 to increase the creeping distance between the primary coil 41 and secondary coil 42 to generate electric isolation. Through the leakage inductance adjustment element 6, different leakage inductances can be adjusted as desired to overcome the difficulty of adjusting leakage inductance in the conventional transformers.

What is claimed is:

1. A composite isolating transformer, comprising:

a main winding rack including two winding portions coaxially formed to hold respectively a primary coil and a secondary coil, two connecting portions at two opposite ends of the two winding portions, a separating portion located between the two winding portions and including two spacers spaced from each other to form a separating section between them to separate the two winding portions, and an installation channel running through the two winding portions to hold an iron core set which is magnetically coupled with magnetic paths generated by the primary coil and the secondary coil when electricity is provided; and a support rack which is mounted onto the main winding rack and includes a first support half member and a second support half member that correspond to each other and couple together to encase at least one of the winding portions; the first support half member and the second support half member including respectively a first cover and a second cover corresponding to each other to cover two lateral sides of the winding portion, respectively a first insulating portion and a second insulating portion corresponding to the separating portion and extending towards the separating section to couple together, and respectively a first isolating portion and a second isolating portion extended from the first insulating portion and the second insulating portion towards the winding portion to cover another two lateral sides of the winding portion;

wherein each of the two connecting portions includes a first retaining portion at the opening of one end of the installation channel and two latch recesses located at two sides of the first retaining portion, the first support half member and the second support half member including respectively a first latch portion and a second latch portion wedged in the two latch recesses and respectively a first positioning portion and a second positioning portion connecting to the first latch portion and the second latch portion to butt the first retaining portion.

2. The composite isolating transformer of claim 1, wherein each of the winding portions includes a second retaining portion located above and corresponding to the first retaining portion, the first support half member and the second support half member including respectively a first ancillary positioning portion and a second ancillary positioning portion to butt one side of the second retaining portion.

3. The composite isolating transformer of claim 2 further including a leakage inductance adjustment element mounted onto the support rack and a magnetic element embedded in the leakage inductance adjustment element, the first support half member including a first assembly portion extended from the first ancillary positioning portion and located above the first latch portion, the second support half member including a second assembly portion extended from the second ancillary positioning portion and located above the second latch portion, the leakage inductance adjustment element including two tracks to couple respectively with the first assembly portion and the second assembly portion.

4. The composite isolating transformer of claim 1, wherein the iron core set is selected from the group consisting of EE, EI, FI, FF, TU, UU and UI types.

5. The composite isolating transformer of claim 1 further including an ancillary insulating portion corresponding to the junction of the first isolating portion and the second isolating portion.

6. The composite isolating transformer of claim 1, wherein the two spacers are formed at different heights.

* * * * *